US007091910B2

(12) United States Patent
Liang et al.

(10) Patent No.: US 7,091,910 B2
(45) Date of Patent: Aug. 15, 2006

(54) ANTENNA ASSEMBLY

(75) Inventors: Jen-Yu Liang, Tu-chen (TW); Tien-Chien Cheng, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 48 days.

(21) Appl. No.: 10/885,913

(22) Filed: Jul. 6, 2004

(65) Prior Publication Data

US 2005/0001775 A1 Jan. 6, 2005

(30) Foreign Application Priority Data

Jul. 4, 2003 (TW) ..... 92118401 A

(51) Int. Cl.
*H01Q 1/24* (2006.01)

(52) U.S. Cl. ..... 343/702; 343/700 MS

(58) Field of Classification Search ..... 343/702, 343/700 MS

See application file for complete search history.

(56) References Cited

U.S. PATENT DOCUMENTS 5,170,173 A * 12/1992 Krenz et al. ..... 343/702
5,572,223 A * 11/1996 Phillips et al. ..... 343/702
5,914,690 A * 6/1999 Lehtola et al. ..... 343/702
6,272,324 B1 * 8/2001 Rudisill et al. ..... 455/575.8
6,337,666 B1 * 1/2002 Bishop ..... 343/795
6,366,261 B1 * 4/2002 Stout et al. ..... 343/872
6,462,938 B1 * 10/2002 Horne et al. ..... 361/681
6,486,837 B1 11/2002 Spiegel et al. ..... 343/702
6,545,642 B1 * 4/2003 Doub et al. ..... 343/702
6,650,298 B1 * 11/2003 Abbasi et al. ..... 343/702
6,856,819 B1 * 2/2005 Itoh ..... 455/575.7
6,864,842 B1 * 3/2005 Hung et al. ..... 343/700 MS

* cited by examiner

*Primary Examiner*—Hoang V. Nguyen
*Assistant Examiner*—Marie Antoinette Cabucos
(74) *Attorney, Agent, or Firm*—Wei Te Chung

(57) ABSTRACT

An antenna assembly includes an electrical device (20) and an antenna coating (10). The electrical device includes a circuit board(22), an insulative cover (11) and a connection portion (24) pivotally interconnecting the circuit board and the insulative cover. The antenna coating is formed on the insulative cover and substantially covers the connection portion, thereby establishing electrical connection with the circuit board via the connection portion. By pivotally rotating the insulative cover on the electrical device, the antenna performance can be improved. Because the antenna coating is directly formed on the insulative cover of the electrical device, the antenna assembly has a simple structure.

14 Claims, 4 Drawing Sheets

ANTENNA ASSEMBLY

BACKGROUND OF THE INVENTION

1. Field of the Invention

The present invention relates to an antenna assembly, and in particular to an antenna assembly having a simple structure.

2. Description of the Prior Art

Following the development of communication technology, especially the development of Wireless Local Area Network (WLAN), Bluetooth and HomeRF, etc., many electronic devices have the function of wireless telecommunication in close range. To achieve the function, an antenna is used in an electronic device for receiving and transmitting signals.

U.S. Pat. No. 6,486,837, issued to Spiegel et al. on Nov. 26, 2002, discloses a conventional antenna assembly mounted in an electrical device. The conventional antenna assembly comprises an insulative substrate carrying antenna element and an insulative base portion supporting the substrate. The substrate defines a plurality of holes to respectively engaging with posts formed on the base portion, thereby being securely mounted on the base portion. The base portion comprises a plurality of fasten portions to be mounted on a circuit board of the electrical device. The antenna assembly comprises a contact electrically interconnecting the antenna element and the circuit board. However, because the substrate must form the holes to engage with the posts of the base portion, the antenna assembly has a complicated structure. The substrate and the base portion must be separately fabricated and then are mounted together, resulting a complicated manufacture and assembly process.

Hence, an improved antenna assembly is desired to overcome the above-mentioned shortcomings of existing antenna assembly.

BRIEF SUMMARY OF THE INVENTION

A main object of the present invention is to provide an antenna assembly having a simple structure while having a good antenna performance.

An antenna assembly in accordance with the present invention comprises an electrical device and an antenna coating. The electrical device includes a circuit board, an insulative cover and a connection portion pivotally interconnecting the circuit board and the insulative cover. The antenna coating is formed on the insulative cover and substantially covers the connection portion, thereby establishing electrical connection with the circuit board via the connection portion. By pivotally rotating the insulative cover on the electrical device, the antenna performance can be improved. Because the antenna coating is directly formed on the insulative cover of the electrical device, the antenna assembly has a simple fabricating process.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
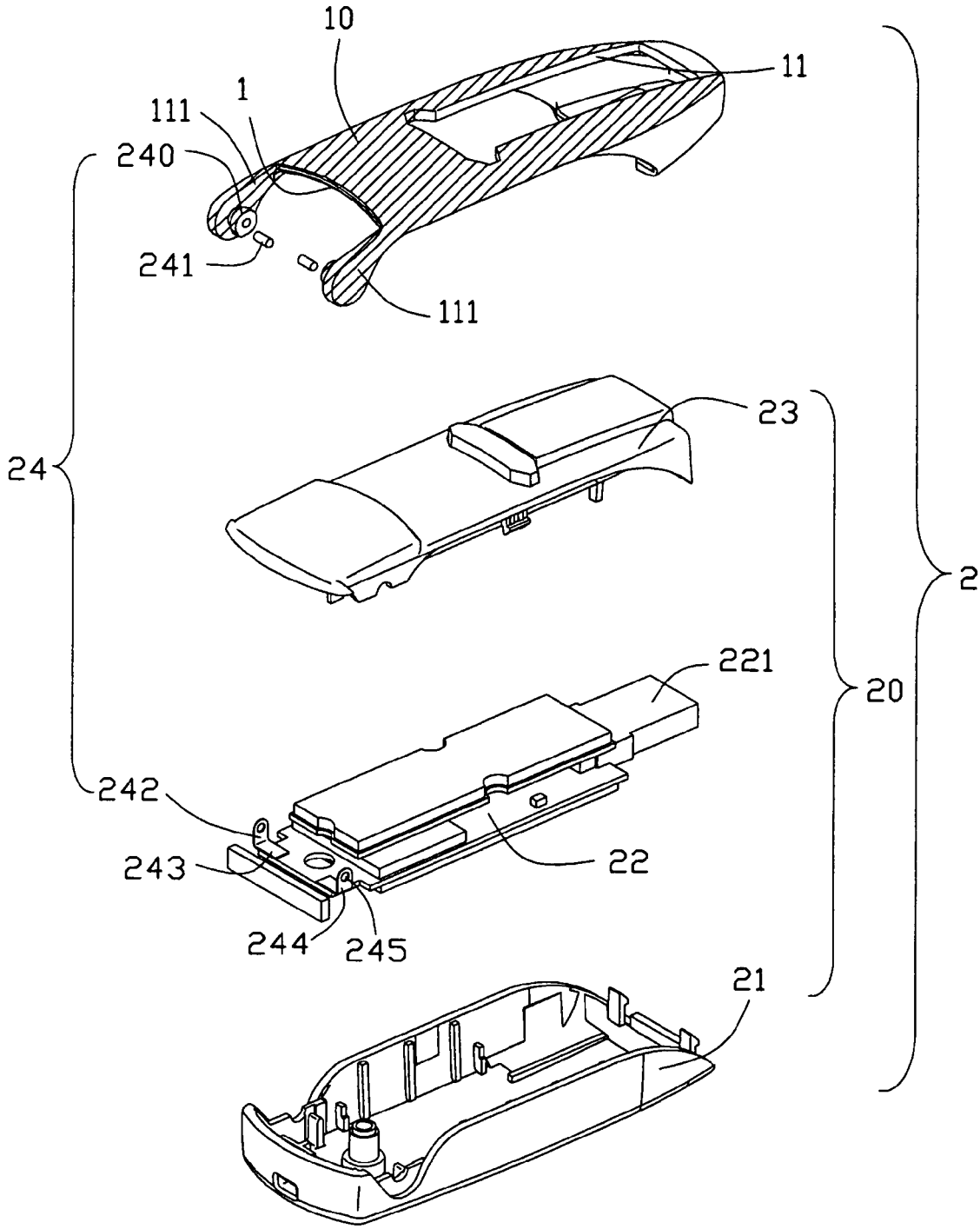
FIG. 1 is an exploded view of an antenna assembly according to the present invention.
Figure 2:
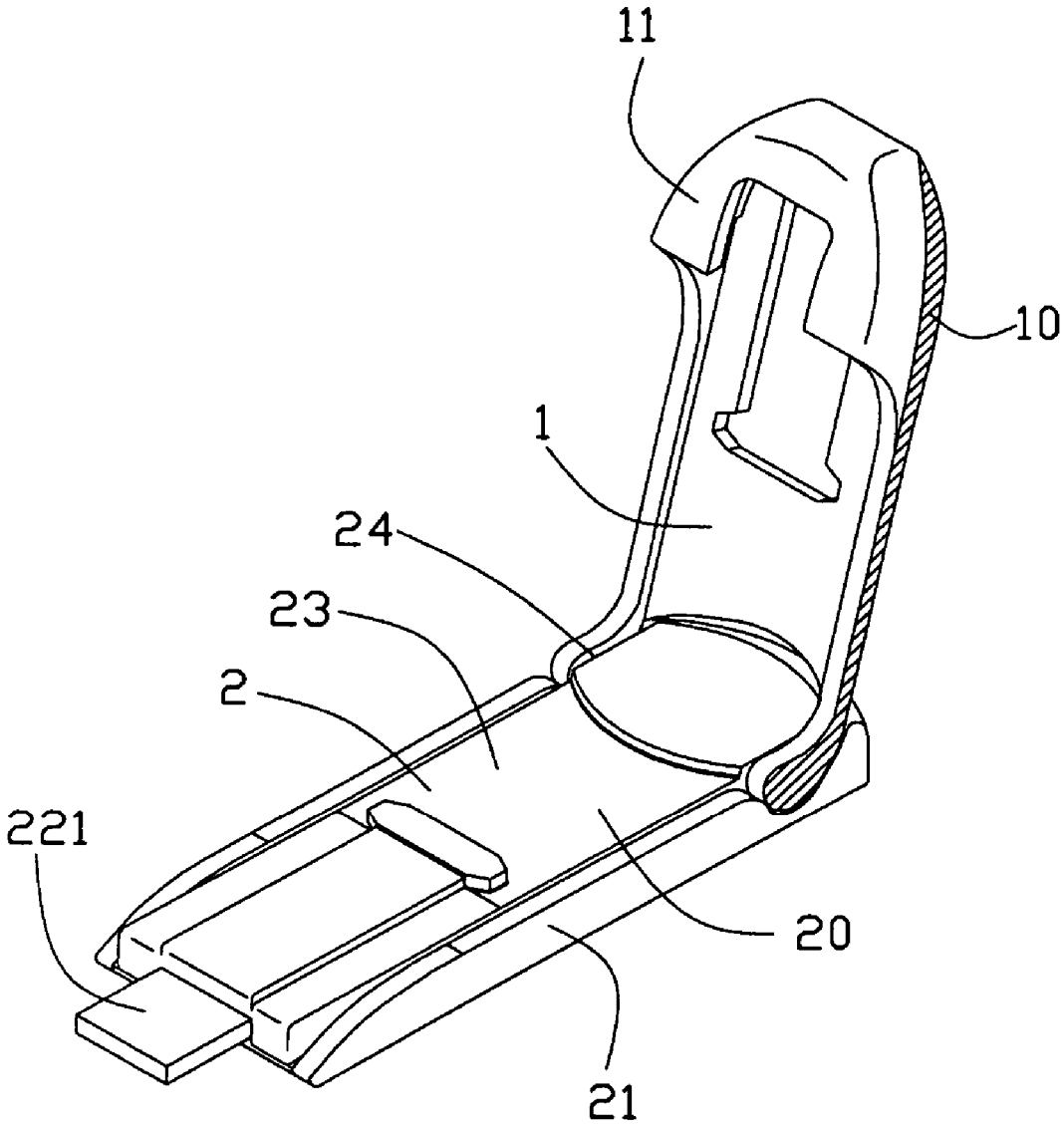
FIG. 2 is an assembled view of FIG. 1.

Referring to FIGS. 1 and 2. an antenna assembly 2 in accordance with a preferred embodiment of the present invention comprises an electrical device 20, an insulative cover 11, and an antenna 1.

In the preferred embodiment, the electrical device 20 is a Bluetooth Module. The electrical device 20 has a substantially rectangular case. The case comprises a lower case 21 and an upper case 23 mounted together defining an interior space (not labeled) for receiving a circuit board 22. The circuit board 22 carries a plurality of electrics components (not labeled) and circuit traces (not shown) for transmitting data and signals. The electrical device 20 comprises a mating port 221 electrically connecting with a front portion of the circuit board 22. The mating port 221 is provided to mate with a complemented engaging port of an electrical apparatus (not shown) for transmitting desired data or signals.

The insulative cover 11 is pivotally connected to a rear section of the circuit board 22 of the electrical device 20 by a connection portion 24, thereby being capable of pivotally covering on the upper case 23 of the electrical device 20. The insulative cover 11 may be generally flat and comprises a pair of legs 111 rearwardly extending from opposite sides of a rear side thereof.

The connection portion 24 comprises a pair of bosses 240, a pair of conductive pieces 242k, and a pair of conductive pivots 241 for interconnecting corresponding bosses 240 and conductive pieces 242. The bosses 240 of the connection portion 24 are respectively and integrally formed on inner surfaces of corresponding legs 111 of the insulative cover 11 and project toward each other. Each conductive piece 242 has an L like configuration and comprises a horizontal section 243 being fixed on the circuit board 22 and a vertical section 244 extending from the horizontal section 243. The horizontal sections 243 are symmetrically fixed on opposite sides of a rear section of the circuit board 22 and electrically connect with corresponding circuit traces of the circuit board 22. Each vertical section 244 defines a hole 245 therethrough for matingly receiving a corresponding pivot 241. The pivots 241 respectively thread through corresponding holes 245 of the conductive pieces 242 and corresponding the bosses 240, thereby pivotally mounting the insulazive cover 11 on the electrical device 20.

The antenna 1 comprises an insulative substrate and a an antenna coating 10 formed on the insulative substrate. In the preferred embodiment, the insulative cover 11 serves as the insulative substrate of the antenna 1. The antenna coating 10 is made of conductive material and is substantially formed on an upper surface of the insulative cover 11. The antenna coating 10 is also formed on surfaces of the legs 111 and the bosses 240, thereby establishing electrical connection with the circuit board 22 via the connection portion 24.

Figure 3:
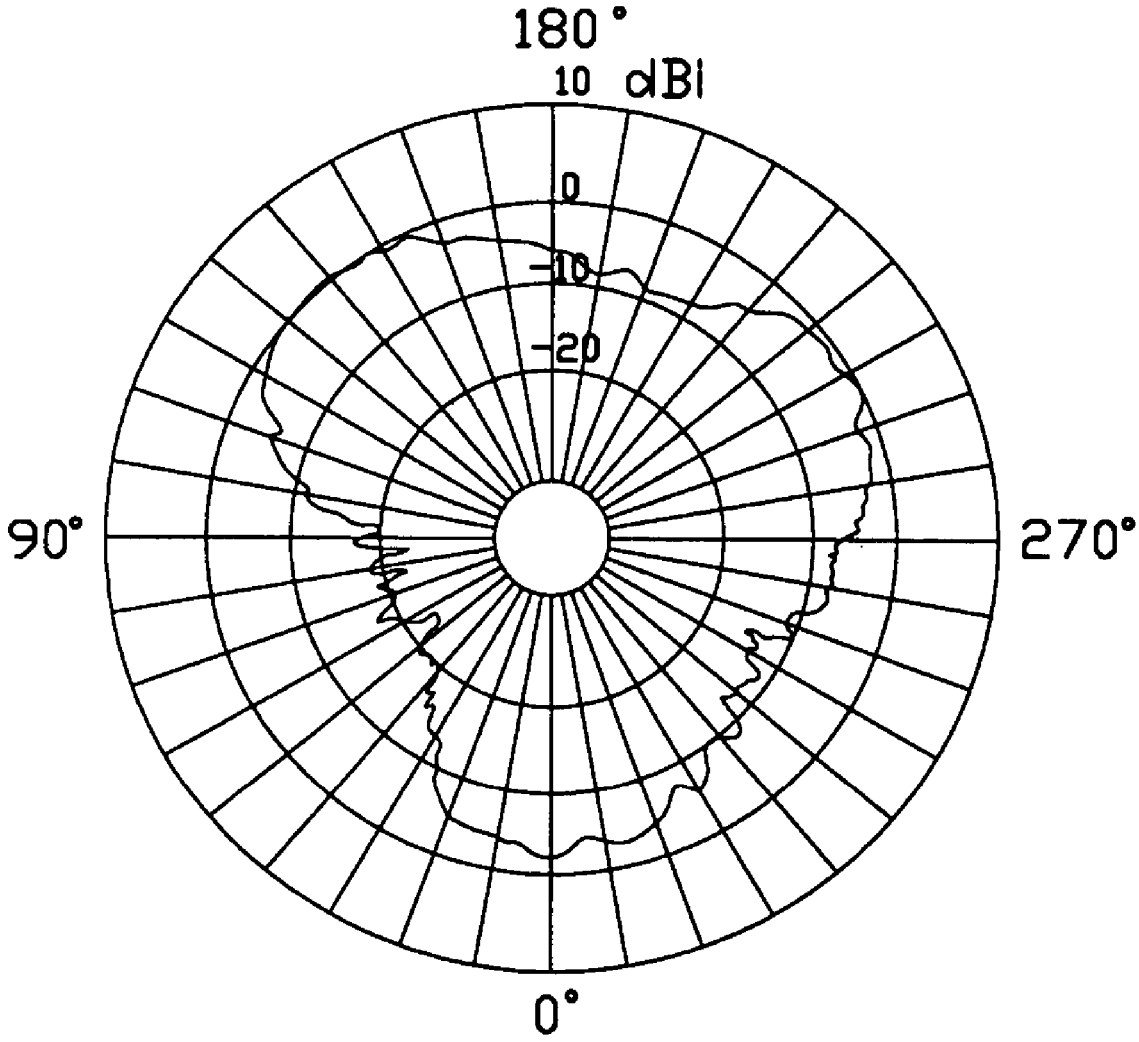
FIG. 3 is a horizontally polarized principle plane radiation pattern of the antenna assembly of FIG. 1 operating at a frequency of 2.45 GHz.
Figure 4:
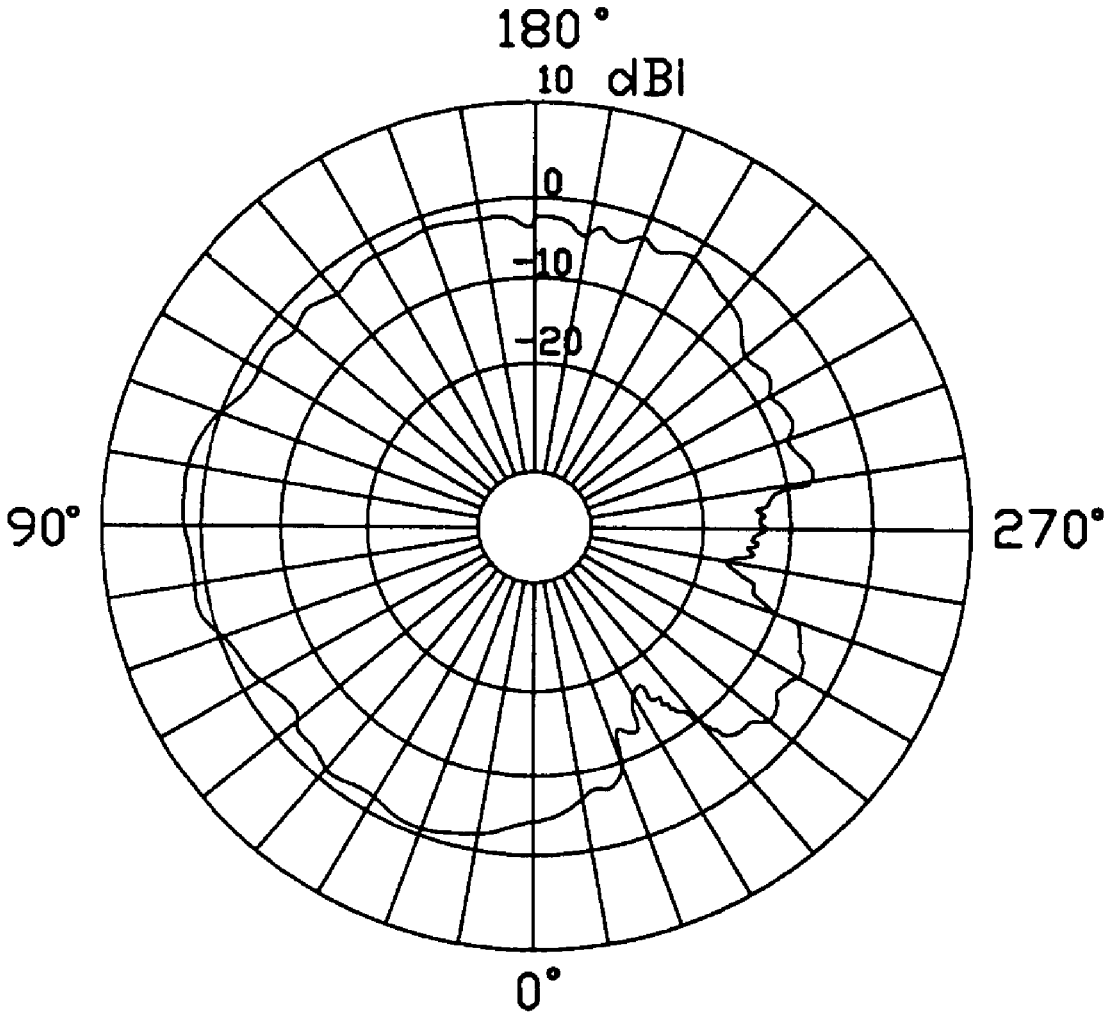
FIG. 4 is a vertically polarized principle plane radiation pattern of the antenna assembly of FIG. 1 operating at a frequency of 2.45 GHz.

By pivotally rotating the insulative cover 11 on the electrical device 20, the antenna performance can be improved. FIGS. 3 and 4 respectively show horizontally and vertically polarized principle plane radiation patterns of the antenna assembly operating at frequencies of 2.45 GHz. Note that each radiation pattern is close to a corresponding optimal radiation pattern.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna assembly comprising:

a circuit board;

an antenna comprising an insulative substrate and a conductive antenna coating substantially formed on the insulative substrate; and a connection portion pivotally connecting the circuit board and the insulative substrate, the connection portion comprising a boss formed on the insulative substrate; wherein the antenna coating is further formed on a surface of the boss.

2. The antenna assembly as claimed in claim 1, wherein the connection portion further comprises a conductive piece electrically connecting with the circuit boards, and a conductive pivot interconnecting the boss and the conductive piece.

3. The antenna assembly as claimed in claim 2, wherein the conducive piece comprises a first section fixed on the circuit board and a second section extending from the first section, the second section defining a hole engagingly receiving the pivot.

4. An antenna assembly, comprising:

an electrical device comprising a circuit board, an insulative cover and a connection portion interconnecting the circuit board and the insulative cover; and an antenna coating formed on the insulative cover and substantially covering the connection portion to establish electrical connection with the circuit board via the connection portion.

5. The antenna assembly as claimed in claim 4, wherein the antenna coating is formed on an upper surface of the insulative cover.

6. The antenna assembly as claimed in claim 4, wherein the connection portion comprises a boss formed on the insulative substrate, a conductive piece electrically connecting the circuit board, and a conductive pivot interconnecting the boss and the conductive piece.

7. The antenna assembly as claimed in claim 6, wherein the insulative cover comprises a leg extending therefrom, the boss integrally projecting from the leg, the antenna coating covering the leg and the boss.

8. The antenna assembly as claimed in claim 6, wherein the conductive piece comprises a first section fixed on the circuit board and a second section substantially perpendicular to the first section, the second section defining a hole, the pivot engaging in the hole to pivotally interconnect the insulative substrate and the circuit board.

9. The antenna assembly as claimed in claim 4, wherein the insulative cover is pivotally rotatable on the electrical device to improve the antenna performance.

10. An antenna assembly comprising:

an electrical device including an internal hidden printed circuit board;

a cover moveably attached to an exterior face of the electrical device and exposed to an exterior so as to attain a superior radiation effect; and an antenna structure compliantly applied to said cover and electrically connected to the printed circuit board; wherein said cover is conductively connected to the printed circuit board via a conductive connection device which mechanically and electrically fastens said cover and the electrical device together.

11. The antenna assembly as claimed in claim 10, wherein said cover is pivotally attached to the electrical device by the connection device.

12. The antenna assembly as claimed in claim 10, wherein said cover essentially dimensionally complies with a main face of the electrical device.

13. The antenna assembly as claimed in claim 10, wherein the connection device has a general L like configuration.

14. The antenna assembly as claimed in claim 10, wherein the connection device comprises a first section fixed on the printed circuit board and a second section generally extending from the first section.

* * * * *